United States Patent [19]

Routledge

[11] Patent Number: 4,541,342

[45] Date of Patent: Sep. 17, 1985

[54] PYROTECHNIC DEVICE WITH METAL DIAPHRAGM AND METAL INSERT

[75] Inventor: Peter Routledge, Lightwater, England

[73] Assignee: EMI Limited, Hayes, England

[21] Appl. No.: 679,082

[22] Filed: Dec. 5, 1984

Related U.S. Application Data

[63] Continuation of Ser. No. 261,884, May 8, 1981, abandoned.

[30] Foreign Application Priority Data

May 9, 1980 [GB] United Kingdom ..... 8015346

[51] Int. Cl.[4] ..... F42B 1/02

[52] U.S. Cl. ..... 102/308; 102/309; 102/329; 102/476; 102/204

[58] Field of Search ..... 102/304, 306, 308, 309, 102/315, 321, 323, 329, 331, 332, 204, 476, 202.5, 202.14, 205; 86/1 A, 1 B

[56] References Cited

U.S. PATENT DOCUMENTS

| | | | |
|---|---|---|---|
| 1,298,500 | 3/1919 | Hardel | 102/315 |
| 2,627,160 | 3/1953 | MacDonald . | |
| 2,929,325 | 3/1960 | Lewis | 102/315 |
| 3,045,524 | 7/1962 | Stresau et al. | 102/501 X |
| 3,097,119 | 7/1963 | Tyson, Jr. | 102/315 |
| 3,124,075 | 3/1964 | Eldh et al. | 102/204 |
| 3,610,151 | 10/1971 | Nett . | |
| 3,678,853 | 7/1972 | Kilmer | 102/275.4 |
| 3,688,702 | 9/1972 | Prior et al. | 102/308 X |
| 3,926,119 | 12/1975 | Hurst et al. | 102/315 X |
| 3,978,791 | 9/1976 | Lemley et al. | 102/202.14 |
| 4,144,814 | 3/1979 | Day et al. | 102/202.14 X |
| 4,259,906 | 4/1981 | Krauch, Jr. et al. | 102/306 X |
| 4,312,271 | 1/1982 | Day et al. | 102/202.14 X |
| 4,336,209 | 6/1982 | Gylden et al. | 86/20 B X |
| 4,347,790 | 9/1982 | Lizen | 102/304 |
| 4,365,556 | 12/1982 | Reibel | 102/331 X |
| 4,471,697 | 9/1984 | McCormick et al. | 102/202.5 X |

FOREIGN PATENT DOCUMENTS

| | | |
|---|---|---|
| 1811375 | 6/1970 | Fed. Rep. of Germany . |
| 2509058 | 9/1976 | Fed. Rep. of Germany . |
| 1256912 | 12/1971 | United Kingdom . |

OTHER PUBLICATIONS

Stroud, John R., "*A New Kind of Detonator–The Slapper*", UCRL-77639, Apr. 1, 1976.

*Primary Examiner*—Peter A. Nelson

*Attorney, Agent, or Firm*—Fleit, Jacobson, Cohn & Price

[57] ABSTRACT

In order to initiate a low explosive (pyrotechnic) mixture with a high explosive detonator, a metal diaphragm preferably of aluminium alloy is interposed between the detonator and the mixture. The diaphragm interacts with the detonation wave so that it initiates the composition.

6 Claims, 4 Drawing Figures

PYROTECHNIC DEVICE WITH METAL DIAPHRAGM AND METAL INSERT

Figure 1:
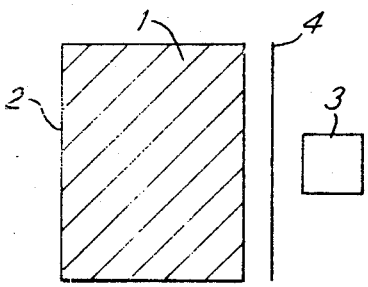

This application is a continuation of application Ser. No. 261,884, filed May 8, 1981, and now abandoned.

The present invention relates to a pyrotechnic device, an example being a pyrotechnic indicator.

A pyrotechnic indicator is an explosive device used to produce light and/or smoke to indicate the operation of for example a fuze.

A conventional indicator comprises a low explosive or pyrotechnic composition which is usually initiated by a heat source called an igniter. The indicator has a commitment time made up of three parts:

(i) the operating time of the igniter from the application of a stimulus;

(ii) the propagation time of the flame from the igniter to the pyrotechnic composition, and (iii) the take-over time of the pyrotechnic composition.

There is a need in some applications to shorten the commitment time and this cannot be achieved using conventional initiation techniques.

A shorter commitment time may be achieved if a low explosive composition could be consistently initiated by a detonation wave. However, the propagation velocity of a detonation wave (about 5000 m/s) is normally too high to raise the temperature of a pyrotechnic composition to a sufficiently high level over an adequate period of time to achieve initiation of the composition. Accordingly it is standard practice to initiate pyrotechnic fillings by an igniter, and indeed, it has hitherto been thought that reliable initiation of a pyrotechnic composition by a high explosive detonator is impossible.

According to the present invention there is provided a pyrotechnic device comprising a pyrotechnic composition, a high explosive detonator, a metal diaphragm interposed between the composition and the detonator to interact with a detonation wave produced by the detonator so as to initiate the composition and a metal insert within the body of said pyrotechnic composition and spaced from the metal diaphragm.

The metal diaphragm interposed between the composition and the detonator so interacts with the detonation wave that it will subsequently initiate the composition.

Thus a much shorter commitment time may be achieved than when using a conventional igniter to initiate the pyrotechnic composition. This arises because:

(a) The operating time of the detonator measured from the application of the stimulus may be much less than the operating time of an igniter, (b) The propagation velocity of the detonation wave may be much higher than the propagation velocity of the flame produced by an igniter, and (c) The take-over time of the pyrotechnic composition from the detonation wave modified after passing through the metal diaphragm may be less than the take over time from the flame produced by an igniter.

The metal diaphragm must be sufficiently thick to interact with and modify the detonation wave, but thin enough to at least locally disintegrate in response to the wave. The takeover time of the composition, and hence the commitment time of the indicator is related to the spacing. Different spacings give different takeover times, which may then be adjusted to meet specific requirements.

Figure 2:
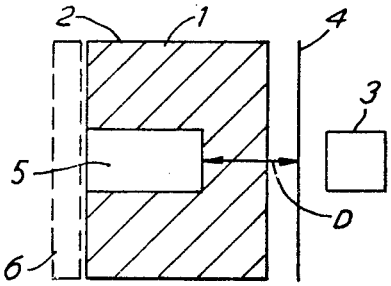
Figure 3:
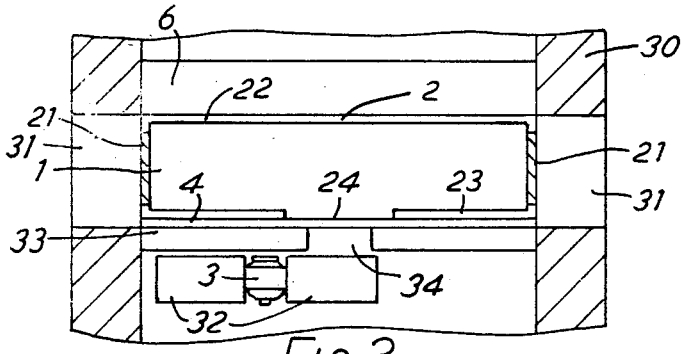
Figure 4:
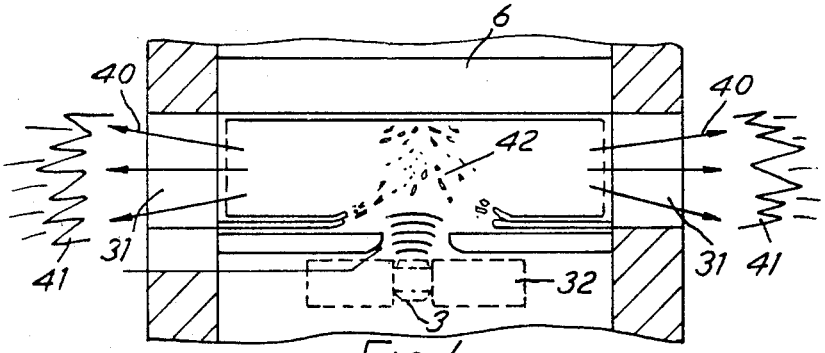

For a better understanding of the present invention, reference will now be made by way of example to the accompanying drawings, in which:

FIG. 1 is a schematic diagram illustrating a pyrotechnic indicator in accordance with the invention, FIG. 2 is a schematic diagram illustrating a modification of the invention of FIG. 1 and FIGS. 3 and 4 are sectional views though part of a practice weapon incorporating the invention.

Referring to FIG. 1 a pyrotechnic composition 1 is contained in a suitable container 2. A high explosive detonator 3 is placed adjacent to the container 2, and a metal diaphragm 4 is interposed between the detonator 3 and the composition 1.

A stimulus is applied to the detonator 3 in response to which it produces a detonation wave. In absence of the diaphragm the wave would not reliably initiate the composition as it would pass through the composition too quickly to sufficiently heat it. The metal diaphragm, however, modifies the wave in such a way as to cause it to initiate the composition.

The diaphragm must be of sufficient thickness to interact with and modify the wave, but must also be sufficiently thin to at least locally disintegrate in response to the wave.

The choice of pyrotechnic composition, detonator and metal diaphragm are inter related.

The following metals are thought to be suitable for use in the diaphragm: aluminium, copper, gold, silver, lead, tin, zinc, iron, magnesium, titanium, nickel, tungsten, cobalt, chromium and uranium and alloys of those metals.

Of these metals it is currently considered that the most useful metals are aluminium, lead, copper, silver, gold, tin and alloys thereof, an aluminium alloy specified hereinafter being preferred.

In the modification shown in FIG. 2, a cylindrical metal insert 5, hereinafter called an anvil, is embedded in the pyrotechnic composition 1. The anvil 5 is spaced from the metal diaphragm 4 by a distance D, which is fixed for any one example of the pyrotechnic indicator. Variation of the distance D varies the take-over time of the pyrotechnic mixture and hence the commitement time of the indicator. The distance D is varied by varying the length of the anvil 5.

The anvil 5 may be replaced by an anvil bar 6 shown in dotted lines in FIG. 2 where the composition has less depth. Furthermore the anvil bar 6 may be additional to the anvil 5.

A specific example of the invention will now be described in relation to an application to a practice weapon, and with reference to FIGS. 3 and 4.

The practice weapon is a bomb which has a cylindrical body 30 which includes a row of circular side vents 31 of which only two are shown. The bomb has in its nose a fuze (not shown) which responds for example to impact to produce a stimulus e.g. an electrical voltage, which is applied to a high explosive detonator 3, carried on a safety and arming mechanism 32 of conventional design. A septum plate 33 is provided between the mechanism 32 and the indicator 1, 2, 4, the plate having a hole 34. The mechanism 32, when released, moves the detonator 3 into line with the hole 34, to allow it to initiate the indicator 1, 2, 4, when detonated.

In this example, the detonator is an electrically initiated detonator known by the designation Detonator Electric C.C. No. 1. This open ended detonator comprises layers of lead azide containing graphite and RDX.

In accordance with this example of the invention, the indicator 1, 2, 4 comprises a pyrotechnic mixture 1 of magnesium powder, potassium perchlorate and graphite. The composition is contained in a container 2 comprising an open ended cylinder of polystyrene 21, a top closure 22 of polythene, and a bottom cap 25 of polythene. The bottom cap has an opening 24 in it adjacent the hole 34 of the septum plate 33. The indicator further comprises a metal diaphragm 4 which is interposed between the septum plate and the bottom cap 23, covering the opening 24. In this example the diaphragm is a disc of aluminium type 425 soft foil tape covered with acrylic adhesive, the thickness of the aluminium beng 0.13 mm.

Two layers of the aluminium foil may be used.

An anvil bar 6 and the septum plate 34 retain the indicator in position.

FIG. 3 shows the indicator and mechanism 32 in its safe condition. Once armed, the detonator 3 is in alignment with the portion 34 as shown in FIG. 4.

As further shown in FIG. 4, once the fuze applies the electrical stimulus to the high explosive detonator 3 a detonation wave is produced which impinges on the aluminium diaphragm 4, disintegrating it, and as modifed by the diaphragm, initiates the pyrotechnic composition which emits light 40 and smoke 41 through the side vents 31. Reference numeral 42 in FIG. 4 indicates detonation energy and particles of aluminum, scattered in the composition and also reflected back from the anvil bar 6.

Test firings of the indicator shown in FIGS. 3 and 4 have given a good visual indication (light and smoke) and have given a commitment time of approximately 100 $\mu$s.

Although the specific example of the invention has been described in relation to a practice weapon, other applications are possible as will be apparent to those skilled in the art. Furthermore, pyrotechnic compositions and detonators other than those specifically mentioned may be used, together with other metals in the diaphragm.

What we claim is:

1. A pyrotechnic device comprising:

a container, a body of a pyrotechnic composition within the container, a first metal plate positioned adjacent to a surface of said body, a second metal plate, having an aperture therein, positioned adjacent to an opposite surface of said body, a high explosive detonator positioned within the container on the side of said aperture remote from said pyrotechnic composition, and a metal diaphragm interposed between the composition and the high explosive detonator so as to cover the aperture, whereby, in use, said metal diaphragm modifies a detonation wave produced by said high explosive detonator and disintegrates locally, at least some of the particulate material produced as a result of disintegration being reflected by said first plate, and said pyrotechnic composition is caused to detonate.

2. A pyrotechnic device comprising a pyrotechnic composition; a high explosive detonator; a metal diaphragm, positioned betwewen the pyrotechnic composition and the detonator, which modifies a detonation wave produced by the detonator and disintegrates locally thereby scattering particular material throughout the body of the pyrotechnic composition causing initiation thereof;

and a metal insert within an end portion of the body of the pyrotechnic composition near said diaphragm and spaced apart from the diaphragm, to influence the take-over time of the pyrotechnic composition.

3. A pyrotechnic device according to claim 2 wherein the metal diaphragm is of a metal selected from the group of metals consisting of aluminium, copper, gold, silver, lead, tin, zinc, iron, magnesium, titanium, nickel, tungsten, cobalt, chromium, uranium and alloys thereof.

4. A pyrotechnic device according to claim 2 wherein the metal diaphragm is of a metal selected from the group of metals consisting of aluminium, lead, copper, silver, gold, tin and alloys thereof.

5. A pyrotechnic device according to claim 2 including a metal plate on the side of said pyrotechnic composition remote from the diaphragm to reflect particulate material.

6. A pyrotechnic device comprising:

a container;

a body of a pyrotechnic composition within the container;

a first metal plate positioned adjacent to a surface of said body;

a second metal plate, having an aperture therein; positioned adjacent to an opposite surface of said body;

a high explosive detonator means for producing a detonation wave and being positioned within the container on the side of said aperture remote from said pyrotechnic composition;

and a metal diaphragm means interposed between the composition and the high explosive detonator so as to cover the aperture, the modifying said detonation wave produced by said high explosive detonator and for disintegrating locally, at least some of the particulate material produced as a result of said disintegration being reflected by said first plate;

whereby said pyrotechnic composition is caused to detonate.

* * * * *